US007950636B2

(12) United States Patent
Kinnison et al.

(10) Patent No.: US 7,950,636 B2
(45) Date of Patent: May 31, 2011

(54) MITER JOINT CLAMP

(75) Inventors: Daniel Kinnison, Kimball, NE (US); George David Stickler, Shorewood, MN (US); Steven Krohmer, Coon Rapids, MN (US)

(73) Assignee: Rockler Companies, Inc., Medina, MN (US)

( * ) Notice: Subject to any disclaimer, the term of this patent is extended or adjusted under 35 U.S.C. 154(b) by 1076 days.

(21) Appl. No.: 11/737,324

(22) Filed: Apr. 19, 2007

(65) Prior Publication Data

US 2008/0258368 A1 Oct. 23, 2008

(51) Int. Cl.
*B25B 1/20* (2006.01)

(52) U.S. Cl. ..... 269/41

(58) Field of Classification Search ..... 269/41, 269/42, 82, 152–155, 237–239, 286
See application file for complete search history.

(56) References Cited

U.S. PATENT DOCUMENTS

| | | | | | |
|---|---|---|---|---|---|
| 451,089 | A | * | 4/1891 | Wagoner | 83/765 |
| 505,024 | A | * | 9/1893 | Brandon | 83/755 |
| 600,118 | A | * | 3/1898 | Bruno | 83/767 |
| 613,189 | A | * | 10/1898 | Cooper | 83/767 |
| 960,159 | A | * | 5/1910 | Dipworth | 83/762 |
| 1,459,094 | A | * | 6/1923 | French | 269/41 |
| 1,704,893 | A | * | 3/1929 | Harrison | 29/258 |
| 1,850,695 | A | * | 3/1932 | Scott | 83/765 |
| 2,322,433 | A | * | 6/1943 | Gammache | 83/762 |
| 2,761,476 | A | * | 9/1956 | Gunas | 269/37 |
| 2,787,825 | A | * | 4/1957 | Holiday | 269/13 |
| 2,941,557 | A | * | 6/1960 | Baprawski | 269/41 |
| 3,888,476 | A | * | 6/1975 | Barton | 269/41 |
| 3,893,362 | A | * | 7/1975 | Schneider et al. | 83/763 |
| 4,019,270 | A | | 4/1977 | Trowbridge | 40/155 |
| 4,033,570 | A | * | 7/1977 | Curlow | 269/41 |
| 4,061,321 | A | * | 12/1977 | Farr | 269/41 |
| 4,162,785 | A | | 7/1979 | Johnson | 269/41 |
| 4,165,869 | A | * | 8/1979 | Williams | 269/41 |
| 4,236,702 | A | | 12/1980 | Keddie | 269/41 |
| 4,247,090 | A | * | 1/1981 | Hahn et al. | 269/41 |
| 4,369,957 | A | * | 1/1983 | Williams | 269/41 |
| 4,377,959 | A | * | 3/1983 | DeCarolis | 83/762 |
| 4,437,375 | A | * | 3/1984 | Elmore et al. | 83/762 |

(Continued)

*Primary Examiner* — Lee D Wilson
*Assistant Examiner* — Jamal Daniel
(74) *Attorney, Agent, or Firm* — Altera Law Group, LLC

(57) ABSTRACT

A miter joint clamp comprises a base and a sled mounted on the base for linear movement with respect to the base. The base has a planar top side, and such movement is relative to a miter joint plane perpendicular to the planar top side of the base. The sled comprises a first sled fence that has a planar first sled surface extending perpendicular to the top side of the base aligned at a 135° angle relative to a first side of the joint plane, with the first sled surface being resiliently compressible relative to the sled in a direction perpendicular to the first sled surface. The sled further comprises a second sled fence that has a planar second sled surface extending perpendicular to the top side of the base and aligned at a 135° angle relative to a second side of the joint plane, with the second sled surface being resiliently compressible relative to the sled in a direction perpendicular to the second sled surface. The base comprises a first base fence that has a planar first base surface extending perpendicular to the top side of the base and aligned generally parallel to the first sled surface, and a second base fence that has a planar second base surface extending perpendicular to the top side of the base and aligned generally parallel to the second sled surface.

18 Claims, 13 Drawing Sheets

U.S. PATENT DOCUMENTS

| | | | | | |
|---|---|---|---|---|---|
| 4,673,174 | A | | 6/1987 | Tabbert | 269/41 |
| 4,789,146 | A | | 12/1988 | Kuei | 269/69 |
| 4,854,565 | A | * | 8/1989 | Ritsch | 269/41 |
| 4,881,726 | A | * | 11/1989 | Jolkovski | 269/41 |
| 4,909,892 | A | * | 3/1990 | Quinn et al. | 156/499 |
| 4,926,722 | A | | 5/1990 | Sorensen et al. | 81/487 |
| 4,984,775 | A | * | 1/1991 | Kahlke | 269/41 |
| 4,995,935 | A | * | 2/1991 | Ganzberger | 156/499 |
| 5,005,449 | A | | 4/1991 | Sorenson et al. | 81/152 |
| 5,172,895 | A | | 12/1992 | Klimach | 269/41 |
| 5,265,854 | A | | 11/1993 | Whiteford | 269/3 |
| 5,384,978 | A | | 1/1995 | Peters | 40/155 |
| 5,405,124 | A | | 4/1995 | Mayer et al. | 269/45 |
| 5,454,551 | A | | 10/1995 | Hobday | 269/6 |
| 5,516,087 | A | | 5/1996 | Schmid et al. | 269/93 |
| 5,573,228 | A | | 11/1996 | Chestnut | 269/41 |
| 5,718,419 | A | * | 2/1998 | Hall | 269/6 |
| 5,730,433 | A | * | 3/1998 | Veres | 269/41 |
| 5,765,808 | A | | 6/1998 | Butschbacher et al. | 254/200 |
| 5,826,310 | A | | 10/1998 | Hobday | 24/514 |
| 5,918,866 | A | | 7/1999 | Klimach | 269/3 |
| 5,931,447 | A | | 8/1999 | Butschbacher et al. | 254/200 |
| 6,098,972 | A | | 8/2000 | Klimach et al. | 269/156 |
| 6,113,085 | A | | 9/2000 | Lindenthal et al. | 269/6 |
| 6,128,993 | A | * | 10/2000 | Zach | 83/453 |
| 6,138,999 | A | * | 10/2000 | Gombinsky | 269/41 |
| 6,393,676 | B1 | | 5/2002 | Dowzall et al. | 24/568 |
| 6,402,131 | B1 | | 6/2002 | Baculy | 269/168 |
| 6,519,825 | B1 | * | 2/2003 | Lambert et al. | 29/281.1 |
| 6,575,442 | B2 | | 6/2003 | Klimach et al. | 269/6 |
| 6,601,837 | B2 | | 8/2003 | Klimach et al. | 269/6 |
| 6,641,122 | B2 | | 11/2003 | Rosesch | 269/6 |
| 6,648,318 | B1 | | 11/2003 | Octlinger et al. | 269/41 |
| D484,017 | S | | 12/2003 | Knox | D8/72 |
| 6,701,596 | B2 | | 3/2004 | Kloepfer et al. | 29/281.5 |
| 6,829,972 | B2 | * | 12/2004 | Chen | 83/761 |
| 6,848,683 | B2 | | 2/2005 | Foshag et al. | 269/3 |
| 6,860,475 | B2 | * | 3/2005 | Wong | 269/41 |
| 6,954,979 | B2 | * | 10/2005 | Logan | 29/700 |
| 7,114,713 | B2 | * | 10/2006 | Brass et al. | 269/45 |
| 7,168,693 | B1 | * | 1/2007 | Sjuts et al. | 269/37 |
| 7,374,158 | B2 | * | 5/2008 | Deming | 269/41 |
| 7,617,578 | B2 | * | 11/2009 | Collins | 29/26 A |
| 7,673,860 | B2 | * | 3/2010 | Ben-Gigi | 269/41 |
| 2004/0007803 | A1 | * | 1/2004 | Wong | 269/41 |
| 2005/0073080 | A1 | * | 4/2005 | Woodbury | 269/41 |
| 2005/0121845 | A1 | | 6/2005 | Bries | 269/41 |
| 2006/0284358 | A1 | * | 12/2006 | Ben-Gigi | 269/41 |
| 2007/0267796 | A1 | * | 11/2007 | Deming | 269/41 |
| 2007/0284796 | A1 | * | 12/2007 | Hummel | 269/41 |
| 2008/0073822 | A1 | * | 3/2008 | Wong | 269/41 |
| 2008/0250905 | A1 | * | 10/2008 | Khan | 83/23 |
| 2008/0258368 | A1 | * | 10/2008 | Kinnison et al. | 269/41 |
| 2010/0025906 | A1 | * | 2/2010 | Cassese | 269/41 |

* cited by examiner

MITER JOINT CLAMP

BACKGROUND

This disclosure relates to clamps for securing miter joint pieces together during assembly. Clamps and joints have been developed for assembling picture frame components and other workpieces having miter joints. However, such tools are often inadequate for their intended purpose, since they may not be easily manipulated by a user, are not readily adaptable for workpiece variations, and/or fail to adequately compensate for joint alignment inaccuracies.

SUMMARY

In one embodiment, a miter joint clamp of the present disclosure comprises a base having a planar top side and a sled mounted on the base for linear movement with respect to the base relative to a miter joint plane and perpendicular to the top side of the base. The sled comprises a first sled fence that has a planar first sled surface extending perpendicular to the top side of the base and aligned at a 135° angle relative to a first side of the joint plane, with the sled surface being resiliently compressible relative to the sled in a direction perpendicular to the first sled surface. The sled further comprises a second sled fence that has a planar second sled surface extending perpendicular to the top side of the base and aligned at a 135° angle relative to a second side of the joint plane, with the second sled surface being resiliently compressible relative to the sled in a direction perpendicular to the second sled surface. The base comprises a first base fence that has a planar first base surface extending perpendicular to the top side of the base and aligned generally parallel to the first sled surface, and a second base fence that has a planar second base surface extending perpendicular to the top side of the base and aligned generally parallel to the second sled surface.

In an alternative embodiment, the miter joint clamp of the present disclosure comprises a base having a planar top side and a sled mounted on the base for linear movement with respect to the base relative to a miter joint plane perpendicular to the top side of the base. The sled has a planar first sled surface extending perpendicular to the top side of the base and aligned at a 135° angle relative to a first side of the joint plane and a planar second sled surface extending perpendicular to the top side of the base and aligned at a 135° angle relative to a second side of the joint plane. The base comprises a first base fence that has a planar first base surface extending perpendicular to the top side of the base and aligned at a 45° angle relative to the first side of the joint plane, wherein the first base fence is pivotally mounted relative to the base on a first pivot axis extending parallel to the miter joint plane, and wherein the first base fence comprises a first cam actuator operable to pivot the first base fence about the first pivot axis. The base further comprises a second base fence that has a planar second base surface extending perpendicular to the top side of the base and aligned at a 45° angle relative to the second side of the joint plane.

This summary is not intended to describe each disclosed embodiment or every implementation of the miter joint clamp. Many other novel advantages, features, and relationships will become apparent as this description proceeds. The figures and the description that follow more particularly exemplify illustrative embodiments.

BRIEF DESCRIPTION OF THE DRAWINGS

The present proposed miter joint clamp will be further explained with reference to the attached figures, wherein like structure or system elements are referred to by like reference numerals throughout the several views.

While the above-identified figures set forth one or more embodiments of the proposed miter joint clamp, other embodiments are also contemplated, as noted in the disclosure. In all cases, this disclosure presents the proposed miter joint clamp by way of representation and not limitation. It should be understood that numerous other modifications and embodiments can be devised by those skilled in the art which fall within the scope and spirit of the principles of the proposed miter joint clamp.

DETAILED DESCRIPTION

A miter joint clamp is used for aligning and clamping workpieces having 45° miter joint faces together for gluing or for the use of other means of fixing such workpieces together (e.g., using mechanical fasteners, such as staples, brads, pins). Such 45° miter joint faces are often encountered, for example, in assembling picture frames or other wooden, polymer or resin components which may be joined at right angles, such as furniture components or cabinet pieces, etc. Specifically, two workpieces (such as adjacent sections of a picture frame) have 45° cut faces which are abutted to define a right angle corner assembly. While abutted, the cut faces may be adhered together by bonding means such as glue, other adhesive, staples, brads or other intermitting mechanical connectors or shapes on the workpieces themselves. In order to achieve an aesthetically pleasing finished joint assembly (e.g., without open cracks or mis-aligned workpiece edges), and to form the strongest assembly possible, the miter joint faces should be abutted as tightly as possible. This then minimizes the appearance of cracks between those sections and allows the formation of the strongest possible assembly.

Figure 1:
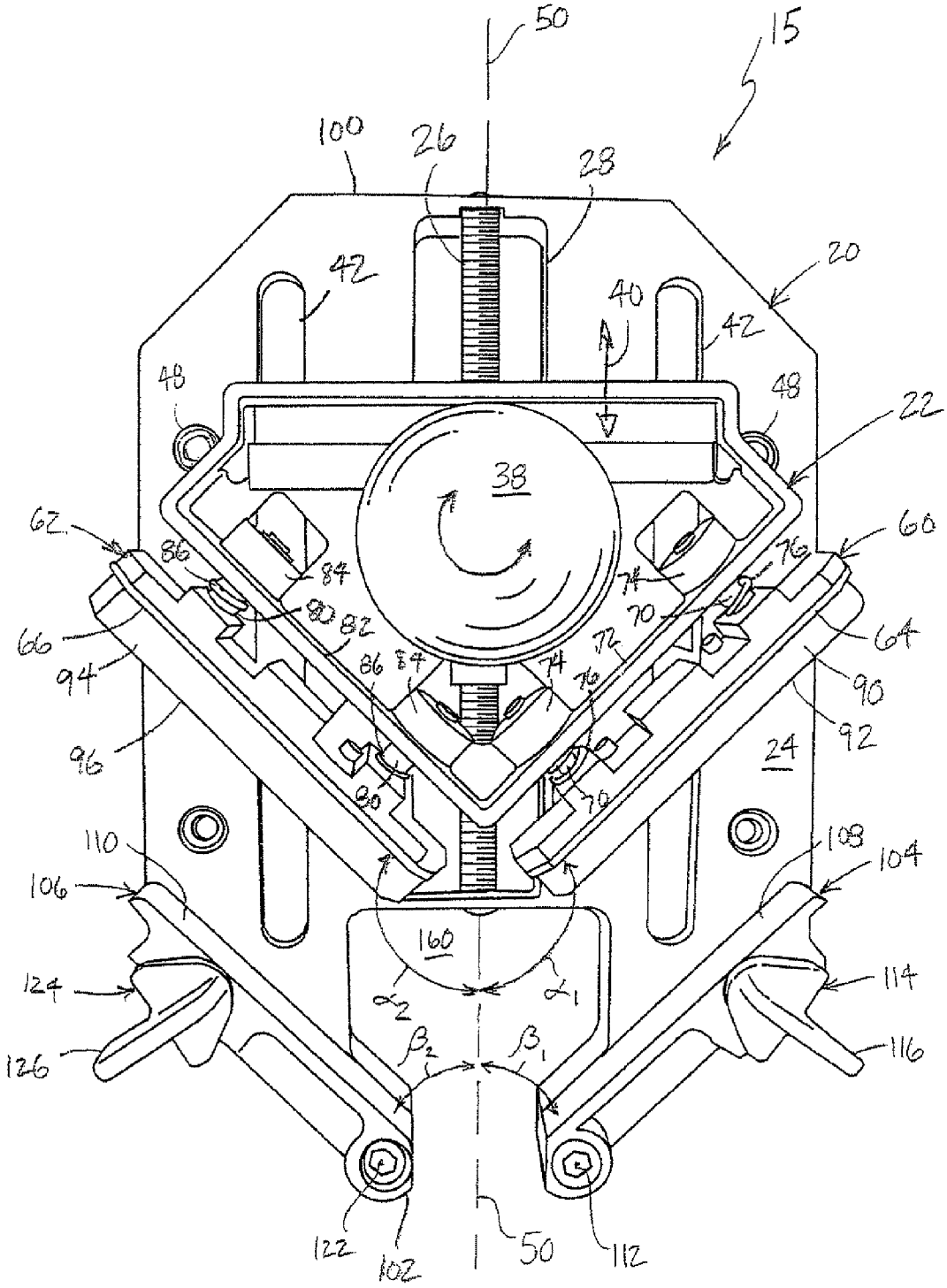
FIG. 1 is a top isometric view of the miter joint clamp of the present invention.
Figure 2:
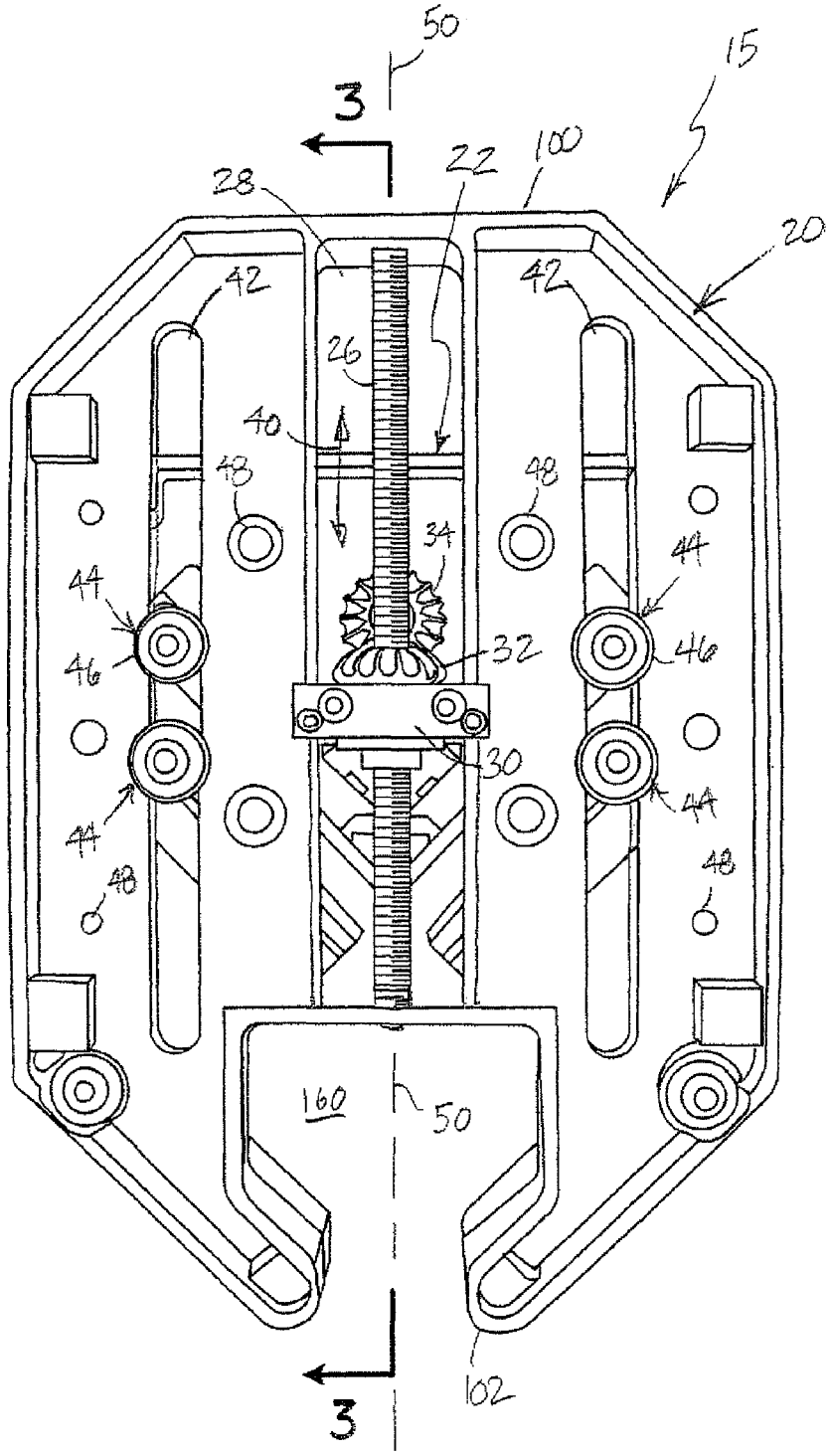
FIG. 2 is a bottom isometric view of the miter joint clamp of FIG. 1.

FIGS. 1 and 2 are top and bottom isometric views, respectively, of a miter joint clamp 15 of the present disclosure. The clamp 15 has a base 20 which supports, among other things, a moveable sled 22. The base 20 has a planar top side 24 over which the sled 22 moves.

Figure 3:
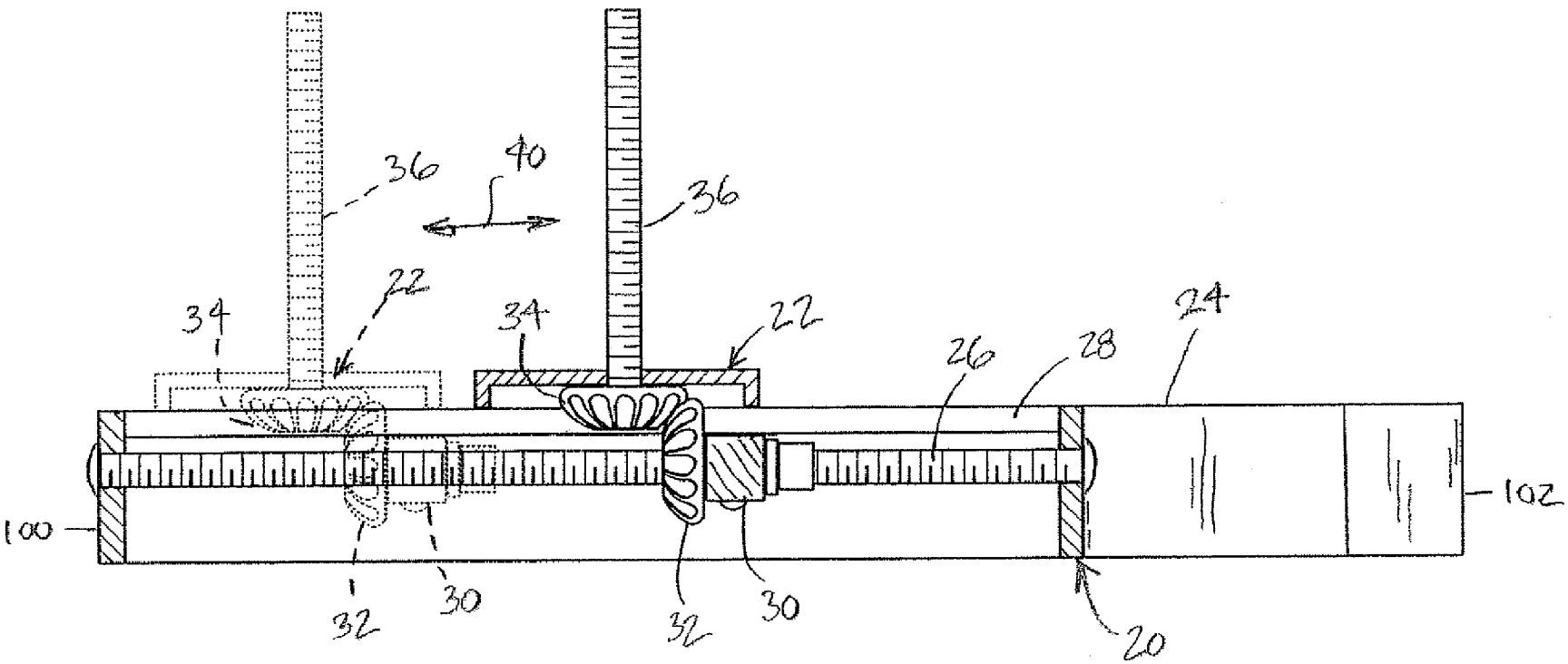
FIG. 3 is a sectional view as taken along line 3-3 in FIG. 2, with some components removed for clarity to illustrate the mechanics for moving the sled linearly with respect to the base.
Figure 4:
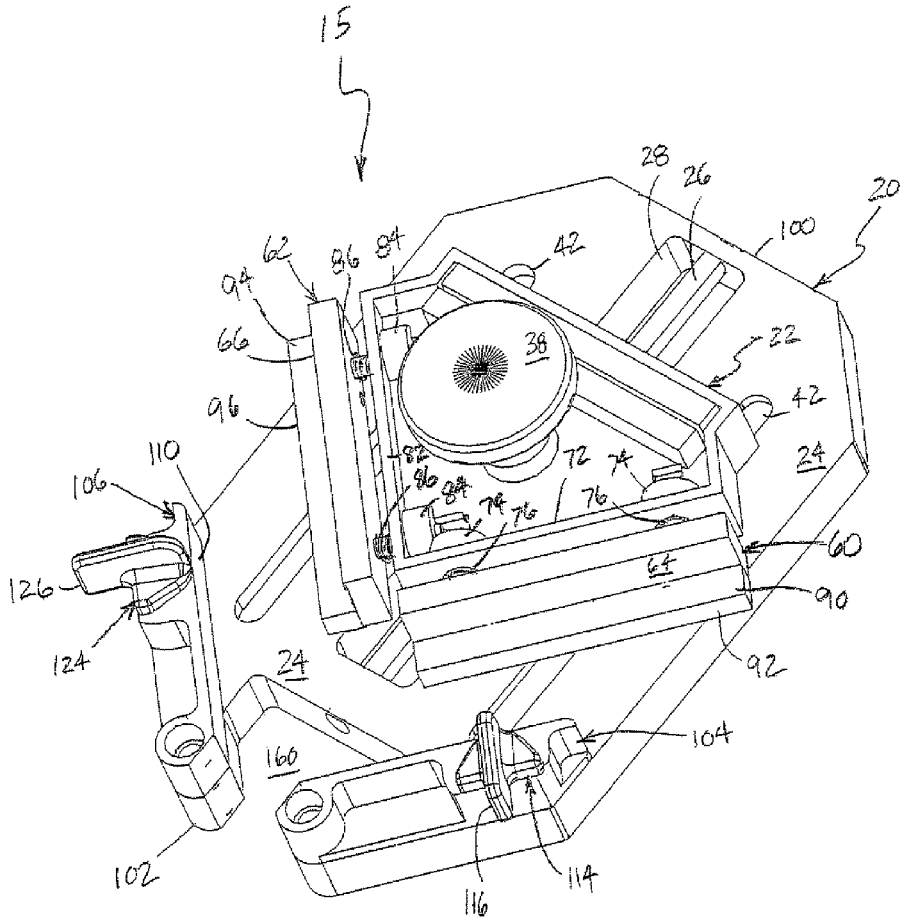
FIG. 4 is an isometric view as taken from the front, top and a first side of the miter joint clamp.
Figure 5:
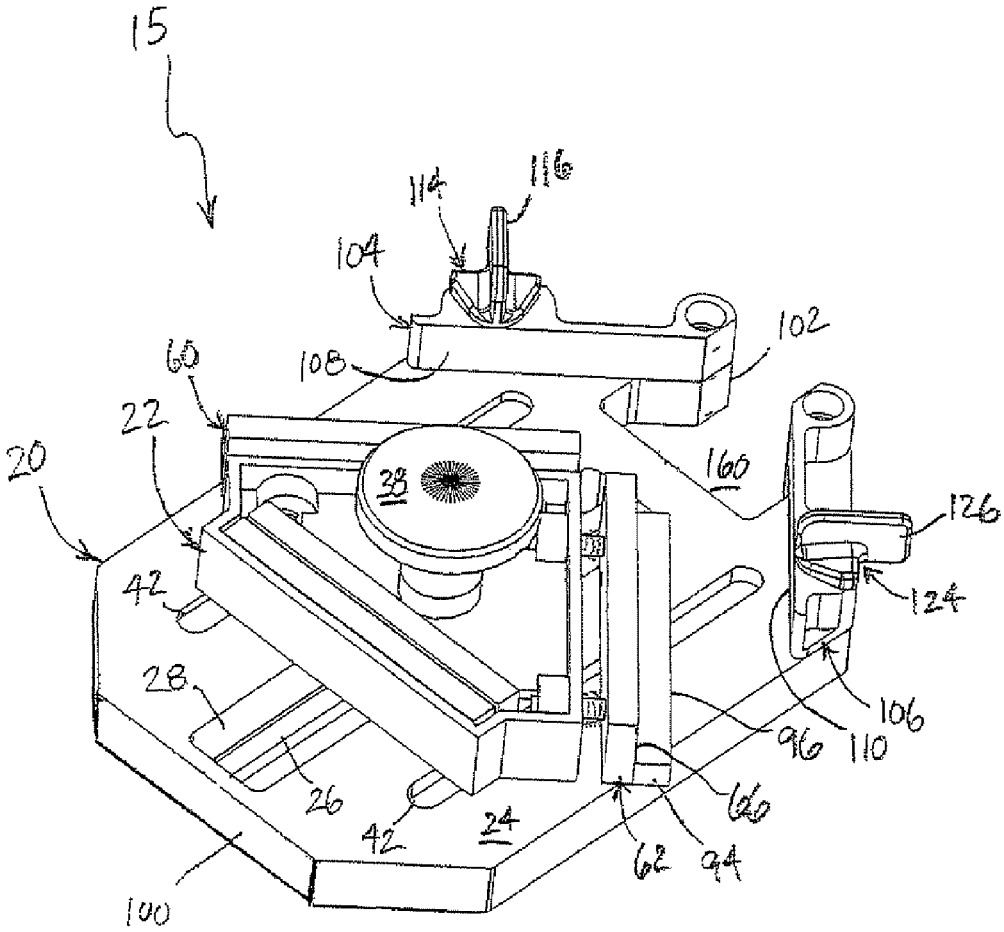
FIG. 5 is an isometric view as taken from the back, top and a second side of the miter joint clamp of FIG. 4.
Figure 6:
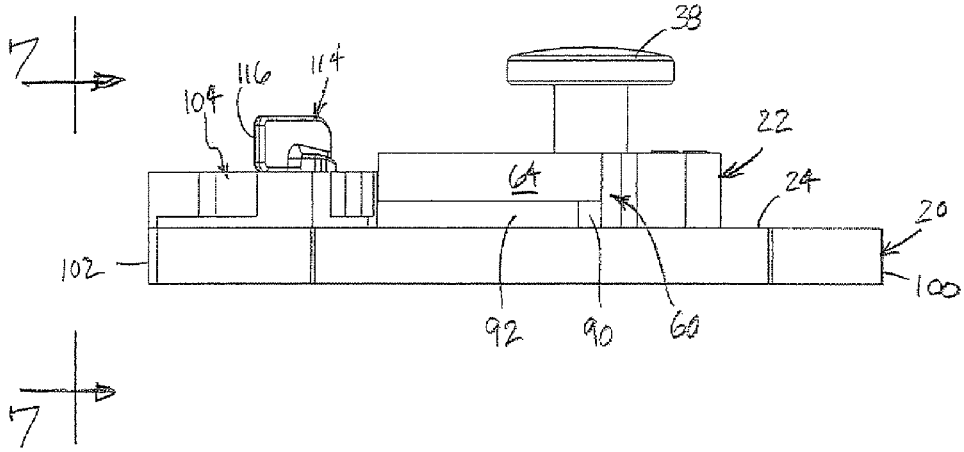
FIG. 6 is a side elevational view as taken from the first side of the miter joint clamp of FIG. 4.

In one embodiment, the movement of the sled 22 relative to the base 20 is achieved using bevel gears. A threaded rod 26 is nonrotatably fixed to the base 20 and accessible from the top of the base 20 through an opening 28 in the top side 24 thereof. A sleeve 30 is mounted on the threaded rod 26, and the sleeve 30 is coupled to a lower bevel gear 32 which is threadably coupled to the threaded rod 26. Rotation of the lower bevel gear 32 relative to the threaded rod 26 moves the lower bevel gear 32 and associated sleeve 30 longitudinally along the threaded rod 26 (as illustrated in FIG. 3). An upper bevel gear 34 engages the lower bevel gear 32 so that the rotation of one bevel gear causes rotation of the other. The upper bevel gear 34 is mounted on a threaded rod 36 which is rotatably supported by the sled 22. At its upper end, the threaded rod 36 has a manipulatable knob or handle 38 to facilitate rotating the threaded rod 36 relative to the sled 22. The sleeve 30 is fixed to the sled 22. Accordingly, manipulation of the knob 38 to cause rotation of the upper bevel gear 34 results in rotation of the lower bevel gear 32 and movement thereof along the threaded rod 26. The sleeve 30 moves with the lower bevel gear 32, thus also moving the sled 22 relative to the threaded rod 26 (and thus relative to the base 20). Such linear movement of the sled 22 relative to the base 20 is illustrated by arrows 40 in FIGS. 1, 2 and 3. The knob 38, rod 36 and upper bevel gear 34 form an assembly on the sled 22 that engages the base 20 and provides a means for adjusting and fixing the position of the sled 22 relative to the base 20 (along the miter joint plane 50).

The top side 24 of the base 20 includes one or more grooves or slots 42, extending parallel to the threaded rod 26. The sled 22 has, depending from a lower side thereof one or more slot engagement members 44 that are sized and aligned to travel in their respective slots or grooves 42. In one embodiment (as seen in FIG. 2), each slot engagement member 44 has an enlarged lower head portion 46 (larger laterally than the width of its respective slot 42) that serves to retain the sled 22 on the base 20. The slot engagement members 44 slide longitudinally relative to their respective slots 42 and assist in maintaining the alignment of the sled 22 relative to the base 20 as it travels back and forth across the top side 24 of the base 20. The sleeve 30 likewise is larger laterally than the width of the slot 28 through which it travels, also serving to retain the sled 22 on the base 20. On its bottom side, as seen in FIG. 2, the base 20 may also be provided with a plurality of apertures or fixtures (such as illustrated by reference numerals 48) for use in securing the sled 22 to a work surface such as a tabletop or a bench, or to some other tool holding fixture.

The top side 24 of the base 20 is a planar surface, along which the sled 22 moves linearly relative to the base 20. The direction of movement is illustrated generally by arrows 40, but is specifically intended for movement along a miter joint plane 50 that extends perpendicular to the planar top side 24 of the base 20 and extends longitudinally relative to the base 20. The miter joint plane 50 is intended to be the plane at which the miter faces of opposed workpieces being joined by the miter clamp 15 come together.

As seen in FIGS. 1 and 2, and also in FIGS. 4-9, 12 and 13, the sled 22 has two sled fences mounted thereon, a first sled fence 60 and a second sled fence 62. The sled fences 60 and 62 are aligned to be generally perpendicular to one another. The first sled fence 60 has a planar first sled surface 64 that extends perpendicular to the top side 24 of the base 20 and is aligned at a 135° angle relative to a first side of the miter joint plane 50, as illustrated by angle $\alpha_1$ in FIG. 1. Likewise, the second sled fence 62 has a planar second sled surface 66 extending perpendicular to the top side 64 of the base 20 and aligned at a 135° angle relative to a second side of the miter joint plane 50, as illustrated by angle $\alpha_2$ in FIG. 1. As such, the first and second planar sled surfaces 64 and 66 are perpendicular to one another, at a right angle bisecting the miter joint plane 50. Of course, as the sled 22 moves linearly relative to the base 20, the first and second sled surfaces 64 and 66 move as well, over and perpendicular to the planar top side 24 of the base 20.

The first sled fence 60 is mounted to the sled 22 to be resiliently compressible relative to the sled 22 in a direction perpendicular to the first sled surface 64. As seen in the FIGS., one means for such mounting includes a pair of spaced apart posts 70 extending rearwardly from the first sled fence 60, perpendicular to the planar first sled surface 64. Each post 70 extends through an aperture (not shown) in a wall 72 of the sled 22, and has an enlarged head 74 mounted thereon. A spring 76 is mounted on each post 70 between the wall 72 and back side of the first sled fence 60. As so assembled, the spring 76 is placed in compression, thus urging the first sled fence 60 away from the wall 72 until the head 74 engages the wall 72 of the sled 22. The second sled fence 62 may be similarly mounted with respect to the sled 22, having like posts 80, extending through apertures in a wall 82 of the sled 22, with enlarged heads 84 and compression springs 86. Other means for allowing the sled surface for a respective sled fence to be compressible relative to the sled in a direction perpendicular to that sled surface are contemplated. For instance, one or more alignment posts and associated apertures may be provided between each sled fence and the sled without a compression spring around each post, or with one or more independently mounted compression springs extending between each sled fence and the sled. In addition, for example, other components may be provided to achieve this function, such as resiliently compressible mounting blocks (e.g., rubber-like blocks) or other compressible structures or mounting materials that will "give" in direction generally perpendicular to the sled surface, but continue to urge or bias that surface away from the sled.

Figure 13:
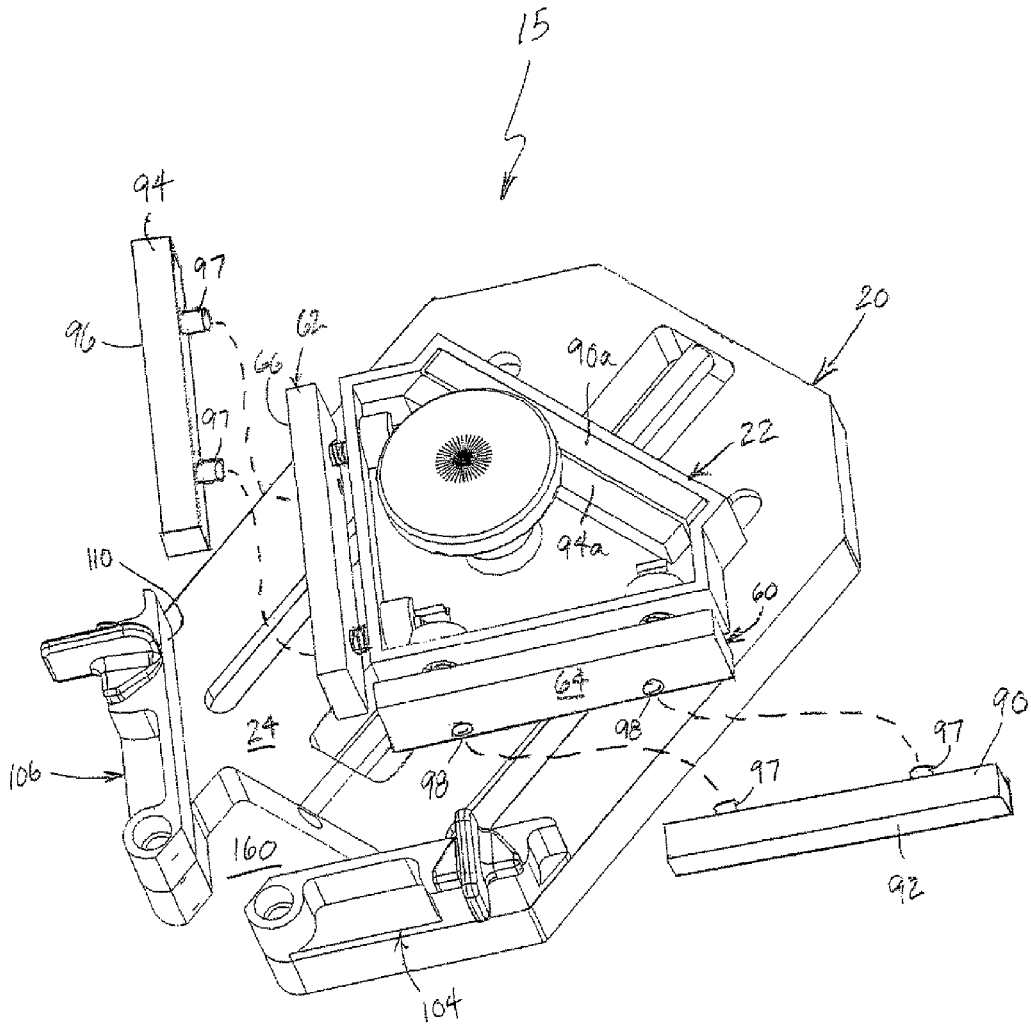
FIG. 13 is an isometric view such as FIG. 4, with surface extension panels of the sled surfaces removed.

The sled surfaces of the sled fences may contact the workpieces being aligned in the miter joint clamp. Alternatively, each sled fence may include one or more extension panels thereon, each of which extends outwardly from its respective planar sled surface. For instance, first sled fence 60 may have a first extension panel 90 removably mounted over a portion of the first sled surface 64 (see, e.g., FIG. 4). The first surface extension panel 90 has a workpiece engagement surface 92 that, when mounted on the first sled fence 60, is parallel with the planar first sled surface 64. Likewise, the second sled fence 62 may have a second surface extension panel 94 removably mounted over a portion of the second sled surface 66 (see, e.g., FIG. 5). The second surface extension panel 94 has a workpiece engagement surface 96 thereon that, when mounted on the second sled fence 62, is parallel with the planar second sled surface 66. When so mounted, the workpiece engagement surfaces 92 and 96 are perpendicular to each other. Each surface extension panel may be aligned and retained on its respective sled fence by cooperative pins 97 and holes 98 (such as illustrated in FIG. 13) or other suitable fastening elements formed to retain the surface extension panel on its respective sled fence during use of the miter joint clamp. In one embodiment, an alternative pair of surface extension panels (having, for example, different dimensions such as the height above the top side of the base or the extension outwardly from its respective first sled surface), are stored atop the sled 22, as illustrated by alternate surface extension panels 90*a* and 94*a* in FIG. 13.

As noted, the sled surfaces 64, 66 of the sled fences 60, 62, respectively, may contact the workpieces being aligned in the miter joint clamp 15. Alternatively, or in addition to, the workpiece engagement surfaces 92, 96 of the surface extension panels 90, 94 may engage the workpieces being aligned in the miter joint clamp 15. In one embodiment, those surfaces or faces contacting the workpieces (whether on the sled fences or the extension panels) have friction enhancing characteristics thereon. The surface of the sled fence or panel material itself may have such characteristics, it has a coating thereon with such characteristics, or another layer of material having such characteristics on an exposed surface thereof is adhered to the surface in question. Friction enhanced, in this context, is intended to mean that once the workpiece is engaged by the surface in question, resistance to movement of the workpiece across the surface in question is provided (i.e., resistance to movement toward and away from the miter joint plane 50).

The sled 22 is moveable, to the extent allowed by the cooperating bevel gears 32 and 34, between a position adjacent a back side 100 of the base 20 and front side 102 thereof. Adjacent the front side 102 of the base 20, the base 20 comprises a first base fence 104 and a second base fence 106. The first base fence 104 has a planar first base surface 108 extending perpendicular to the top side 24 of the base 20. The first base surface 108 is aligned generally parallel to the first sled surface 64. Accordingly, the first base surface 108 is aligned at a 45° angle relative to the first side of the miter joint plane 50, as illustrated by angle $\beta_1$ in FIG. 1. Likewise, the planar second base surface 110 of the second base fence 106 extends perpendicular to the top side 24 of the base 20. The second base surface 110 is aligned generally parallel to the second sled surface 66. Accordingly, the second base surface 110 is aligned at a 45° angle relative to the second side of the miter joint plane 50, as illustrated by angle $\beta_2$ in FIG. 1.

The first and second base surfaces 108 and 110 contact the workpieces being aligned in the miter joint clamp 15, as seen in FIGS. 8-12. In one embodiment, those surfaces or faces contacting the workpieces (i.e., base surfaces 108, 110) may have friction reducing characteristics thereon. The surface of the base fence material itself may have such characteristics, it has a coating thereon with such characteristics, or another layer of material having such characteristics on an exposed surface thereof is adhered to the surface in question. In this context, friction reducing is intended to mean that once the workpiece is engaged by the surface in question, there is little resistance to movement of the workpiece across the surface in question (i.e., a workpiece is readily slidable along the surface toward and away from the miter joint plane 50).

Figure 7:
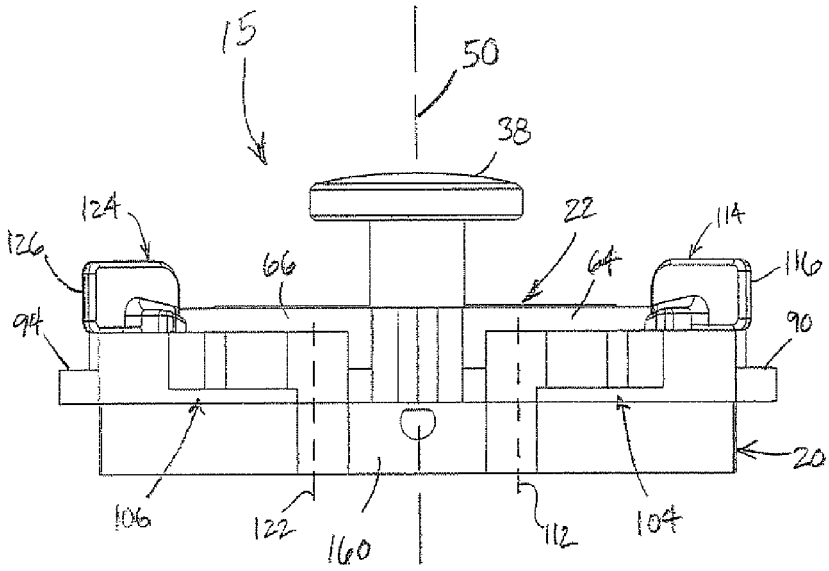
FIG. 7 is an elevational view as taken along line 7-7 in FIG. 6.
Figure 8:
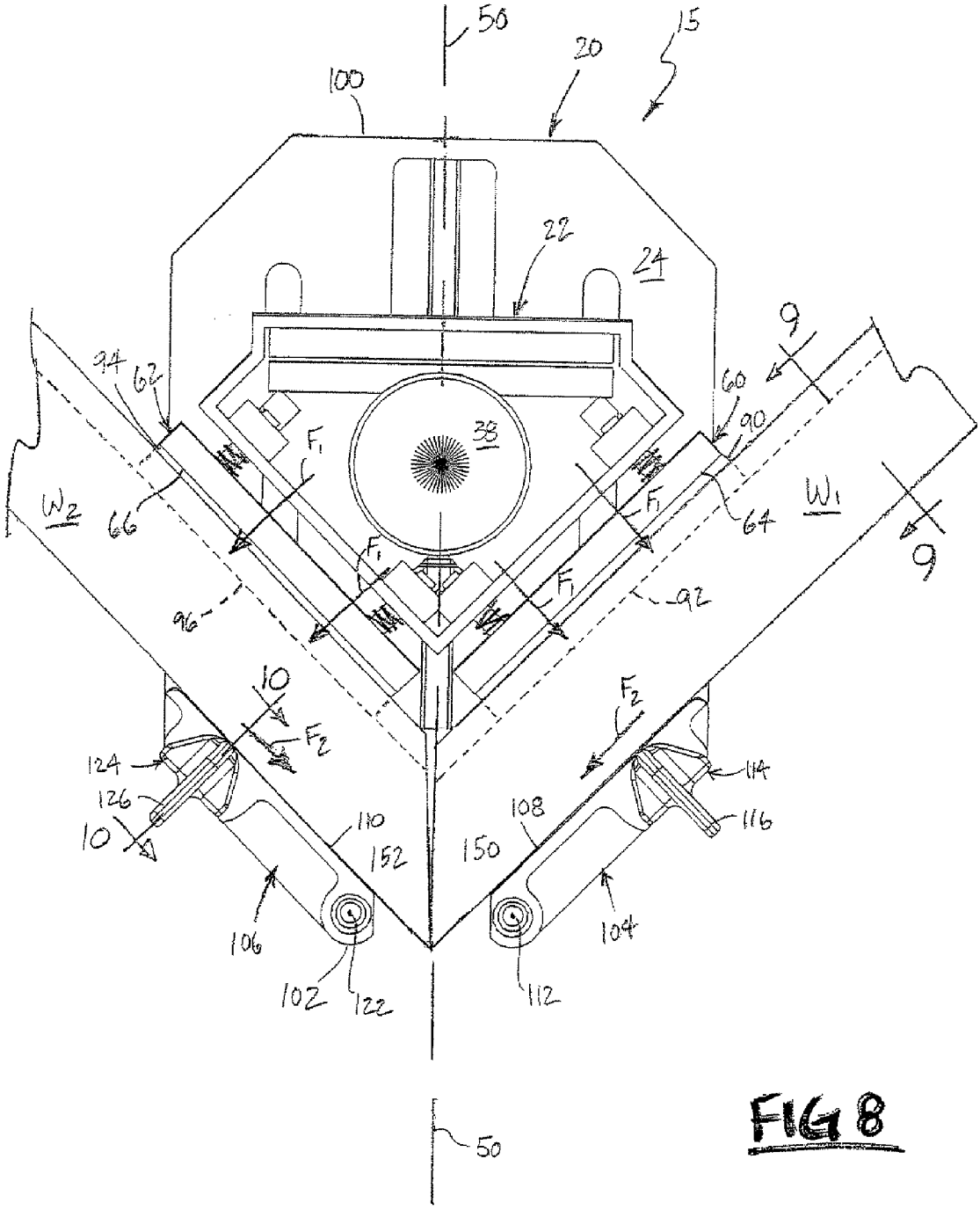
FIG. 8 is a top plan view of the miter joint clamp of FIG. 4 with a pair of mitered workpieces initially aligned therein for clamping.
Figure 9:
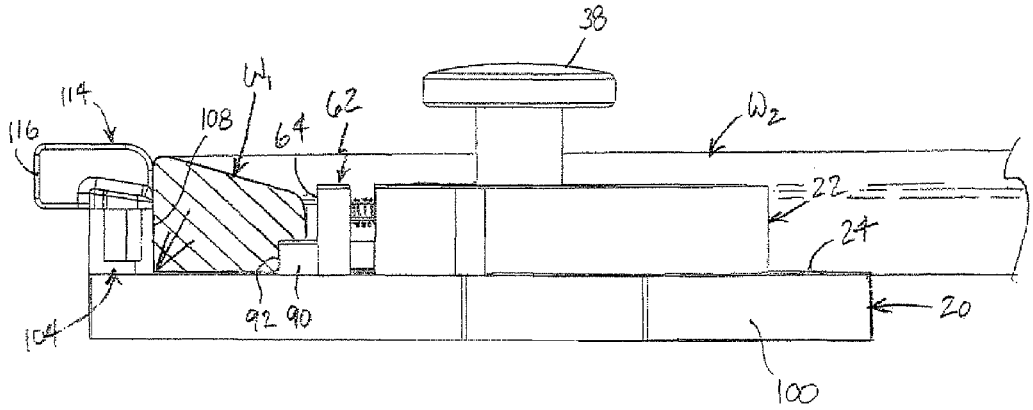
FIG. 9 is a sectional view as taken along line 9-9 in FIG. 8.

In one embodiment, the first base fence 104 is pivotally mounted to the base 20 on a first pivot axis 112 extending parallel to the miter joint plane 50 (see, e.g., FIGS. 1, 7 and 8). This mounting arrangement is such that the first base fence 104 is affixed to the base 20, but allowed to pivot over a portion of the top side 24 thereof. Such pivoting is caused and controlled by a first cam actuator 114 operably disposed on the first base fence 104 to provide a camming action relative to the base 20. The first cam actuator 114 has an operator engageable lever 116 to facilitate rotation of the first cam actuator 114 and consequent movement of the first base fence 104 relative to the base 20. The lever 116 allows easy manipulation of the first cam actuator 114 by a user and also provides an indicator (i.e., pointer) of relative camming motion to the user.

Likewise, the second base fence 116 is pivotally mounted to the base 20 on a second pivot axis 122 extending parallel to the miter joint plane 50 (see, e.g., FIGS. 1, 7 and 8). The second base fence 106 is connected to the base 20 by such mounting attachment, thereby securing the second base fence 106 to the base 20 yet allowing its pivoting relative to a portion of the top side 24 of the base 20. The second base fence 106 may also comprise a second cam actuator 124 thereon which is operable relative to the base 20 to cause and control the pivoting of the second base fence 106 about the second pivot axis 122. The second cam actuator 124 also has an operating engageable lever 126 to facilitate rotation of the second cam actuator 124 and consequent movement of the second base fence 106 relative to the base 20. The lever 126 allows easy manipulation of the second cam actuator 124 by a user and also provides an indicator (i.e., pointer) of relative camming motion to the user.

Figure 10:
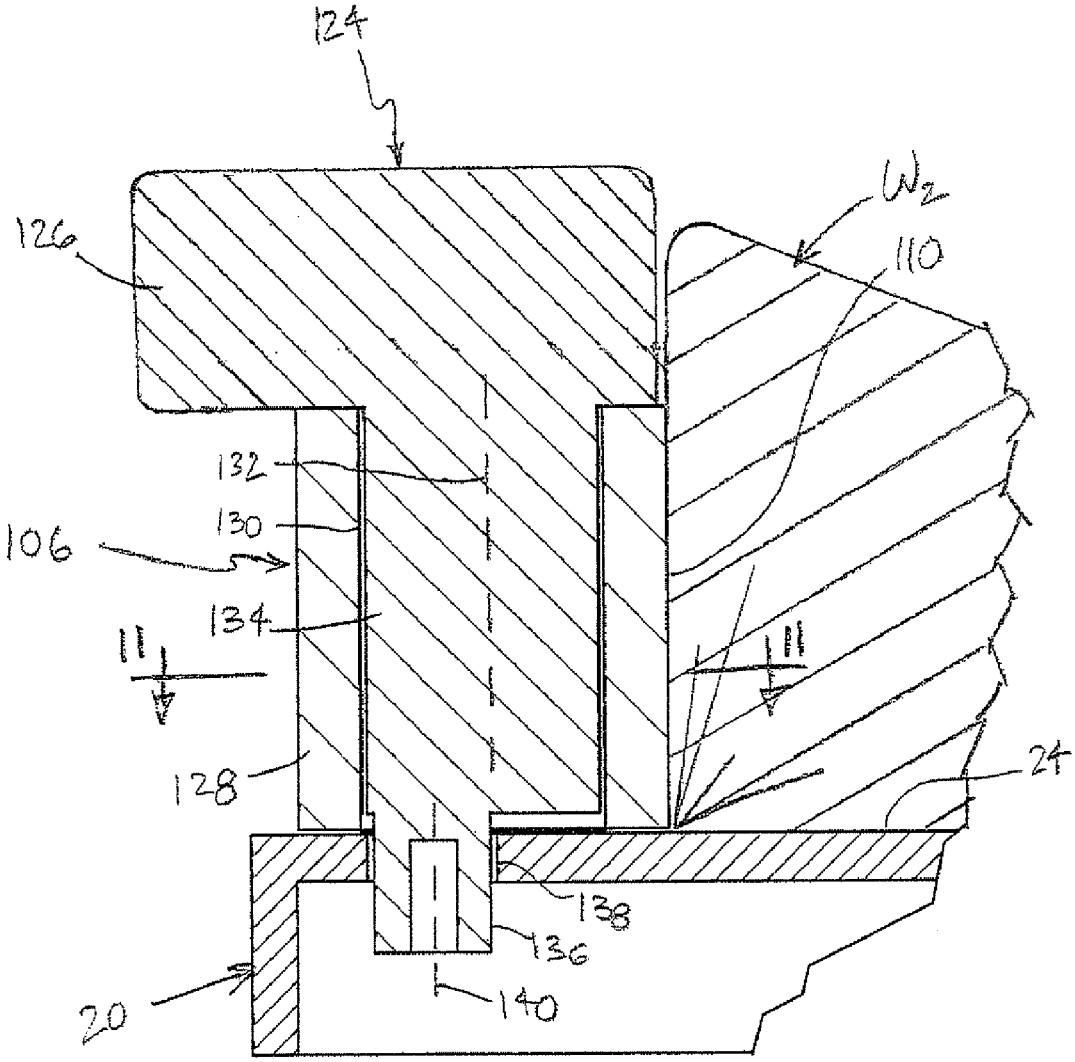
FIG. 10 is a partial sectional view as taken along line 10-10 in FIG. 8.
Figure 11:
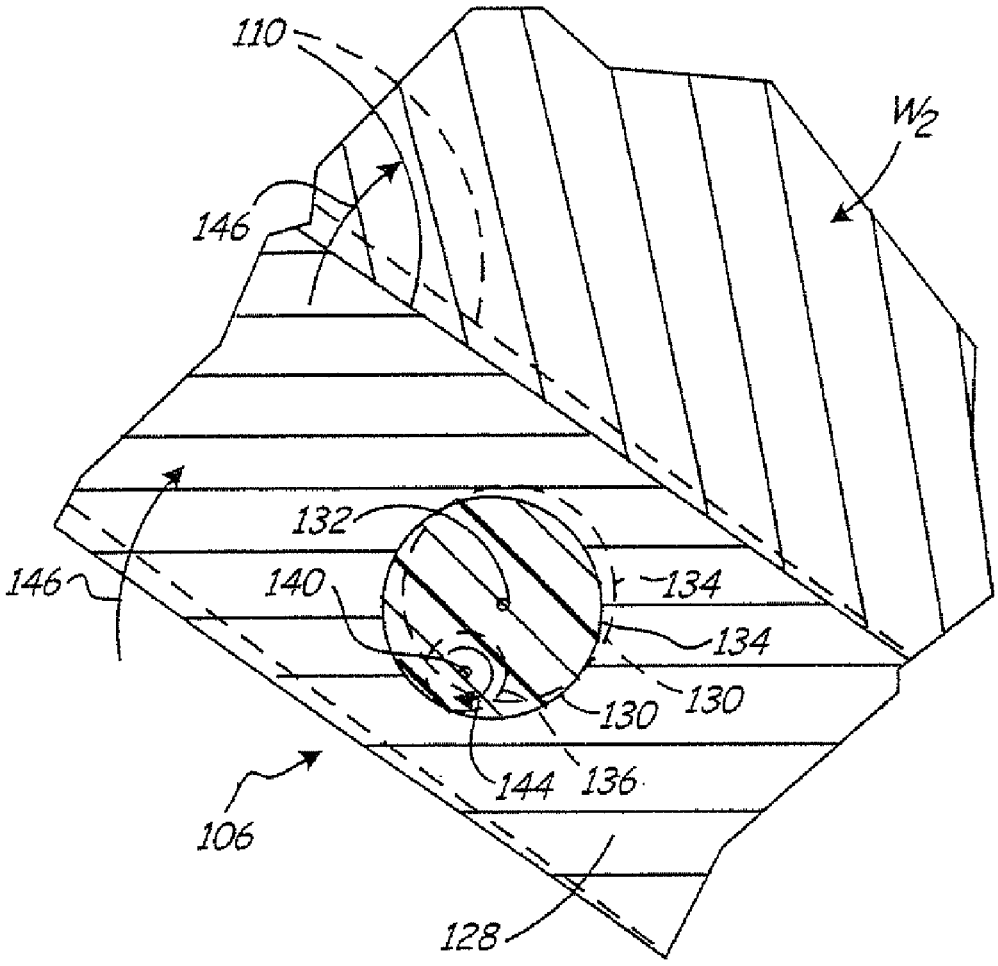
FIG. 11 is a sectional view as taken along line 11-11 in FIG. 10.

FIGS. 10 and 11 provide exemplary views of a cam actuator in combination with a base fence. The second base fence 106 has a body 128 with a cylindrical bore 130 therethrough defined about an axis 132 (that is parallel to the pivot axis 122). The second cam actuator 124 has a cylindrical projection 134 which is rotatably received within the bore 130 of the body 128. A cylindrical pivot projection 136 extends from a bottom end of the cylindrical projection 134. The pivot projection 136 extends through a circular hole 138 in the top side 24 of the base 20. The circular hole is formed about a pivot axis 140 (that is parallel to the pivot axis 122.

Figure 12:
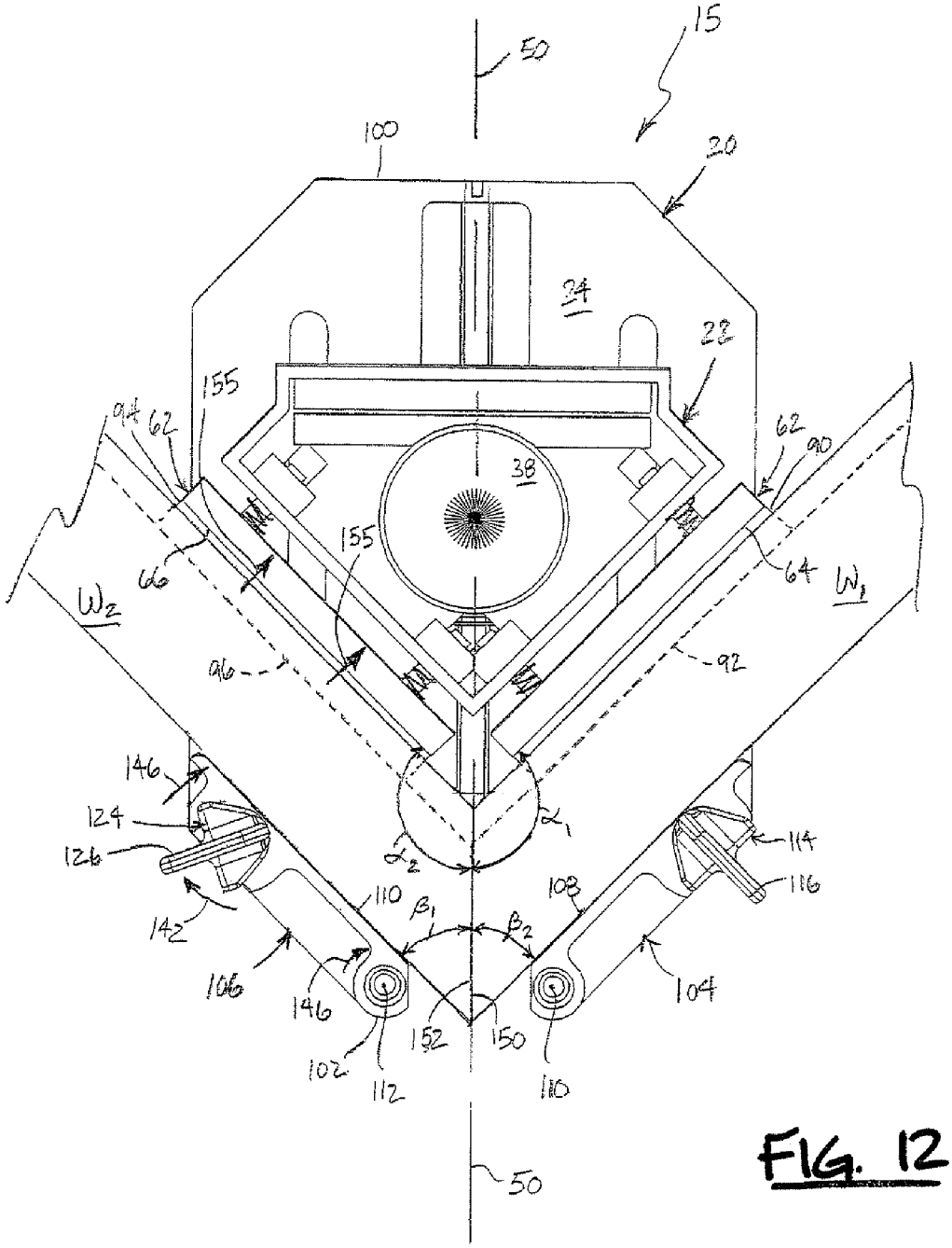
FIG. 12 is a top plan view of the assembly of FIG. 8, with one of the base fences manipulated to abut the miter joint faces of the two mitered workpieces.

As illustrated in FIG. 12, the second cam actuator 124 may be rotated (as indicated by arrows 142) relative to its base fence 106. That rotation, because of the offset axes 132 and 140, causes rotation of the pivot projection 136 within the hole 138, as indicated by arrow 144 in FIG. 11. Because the axes 132 and 140 are offset, this motion results in pivoting of the second base fence 106 about its second pivot axis 112, as indicated by arrows 146 in FIGS. 11 and 12. During such pivoting, the second base surface 110 may move from a first position (as illustrated by solid lines in FIG. 11) to a second position (as illustrated by phantom lines in FIG. 11). FIG. 11 also illustrates (in solid and phantom lines) the relative change in position of the second base fence body 128 and the cylindrical projection 134 extending through the bore 130 thereof.

FIGS. 8-12 illustrate the miter joint clamp 15 with a pair of workpieces $W_1$ and $W_2$. Workpiece $W_1$ is positioned between the first sled fence 60 and the first base fence 104, while workpiece $W_2$ is between the second sled fence 62 and the second base fence 106. The workpieces $W_1$ and $W_2$ have cut or formed miter faces 150 and 152 thereon, respectively. Each miter face 150 and 152 is intended to be cut or formed at a 45° angle relative to the length extent of its respective workpiece. However, as illustrated in FIG. 8, when the faces 150 and 152 are abutted within the miter joint clamp 15, a slight misalignment may be present so that the faces 150 and 152 are not fully abutted. As noted above, the workpiece engaging surfaces of the sled fences have friction enhancing characteristics while the workpiece engaging surfaces of the base fences have friction reducing characteristics. Further, the sled fences are biased away from the sled. Accordingly, when a workpiece is positioned between the sled and base fences and the sled 22 is advanced by manipulation of the knob 38 and associated bevel gears toward the front end 102 of the base 20, the workpiece is more affirmatively engaged by the surfaces of the sled fence than the surfaces of the opposed base fence. As the workpiece is engaged between the opposed surfaces of the sled fence and opposed base fence, the sled places vector clamping forces $F_1$ on the workpiece (see FIG. 8). Those forces are translated into vector forces $F_2$ by engagement of the workpiece with the sled fence, thereby urging the workpieces together at the miter joint plane 50.

When a misalignment occurs (as illustrated in FIG. 8), it may be overcome by actuation of one or both of the cam actuators on the base fences. FIG. 12 illustrates, as noted above, a rotation of the second cam actuator 124, thereby realigning the workpiece $W_2$ relative to the workpiece $W_1$ and resulting in a fully abutted miter joint along the opposed faces 150 and 152 of the workpieces $W_1$ and $W_2$. The abutted faces 150 and 152 are aligned along the miter joint plane 50, as seen in FIG. 12. Because of the friction reducing surface on the second base surface 110, the pivoting motion of the second base fence 106 allows its relative movement along the engaged edge of the workpiece $W_2$, thereby permitting the alignment necessary between the workpieces $W_1$ and $W_2$ to compensate for any gap or misalignment between the opposed workpiece faces 150 and 152. Further, biased mounting of the second sled fence 66 relative to the sled 22 allows compression thereof relative to the second base fence 106 (if necessary) to compensate for movement of the workpiece $W_2$ caused by the movement of the second base fence 106 (as indicated by arrows 155 in FIG. 12).

A first operative angle alignment of the first base surface 108 relative to the miter joint plane 50 is 45°, and a second operative angle alignment of the second base surface 110 relative to the joint plane 50 is 45°. In one embodiment, each base fence 104, 106 is pivotable by its respective cam actuator 114, 124 to within +/−2° of the respective operative angle alignment for the base surface of that base fence. This angular degree adjustability is measured with respect to angles about the respective pivot axes of the first and second base sleds 104, 106, (pivot axes 112 and 122, respectively).

The base 20 has an open section 160 therethrough adjacent its front end 102 (as seen in FIGS. 1, 2, 4, 5, 7 and 13). The open section 160 between the first and second base fences 104 and 106, and between portions of the sled fences 60, 62 and the base fences 104, 106, allows user access from below the miter joint clamp 15, thereby allowing inspection of the miter joint being formed from both above and below, and also permitting the insertion (from below) of mechanical fasteners and the like between the two abutted workpieces $W_1$ and $W_2$ while those workpieces are fixed within the miter joint clamp 15. Of course, prior to abutting the opposed faces 150 and 152 of the workpieces $W_1$ and $W_2$, respectively, glue or another suitable adhesive may be disposed therebetween.

The miter joint clamp 15 provides an easy to use means for aligning and clamping two workpieces together to form a right angle miter joint therebetween. The two workpieces are positioned between the respective first and second sled and base fences of the miter joint clamp 15, as shown generally in FIG. 8. Clamping of the workpieces is achieved simply by rotation of knob 138 on the sled 22 which causes advancement of the sled toward the front end 102 of the base 20. As some point, the sled 22 is advanced to a degree that each workpiece is engaged by a sled fence on the sled and base fence on the base. Further movement of the sled 22 relative to the base 20 may result in compression of the sled fences thereon relative to the sled 22. If the workpieces are not fully aligned in an abutting relationship along the miter joint plane 50, one or both of the base fences may be slightly pivoted to further force the workpiece abutting faces into engagement along the miter joint plane 50, by manipulation of the cam actuators thereon. The features of the miter joint clamp 15 allow for compensation in the formation of the abutting faces of workpieces $W_1$ and $W_2$ to minimize the appearance of the crack or joint there between (as seen in FIG. 12).

Although the miter joint clamp of this disclosure has been described with reference to preferred embodiments, workers skilled in the art will recognize that changes may be made in form and detail without departing from the spirit and scope of the disclosure.

What is claimed is:

1. A miter joint clamp comprising:

a base having a planar top side; and a sled mounted on the base for linear movement with respect to the base relative to a miter joint plane perpendicular to the top side of the base, wherein the sled comprises:

a first sled fence that has a planar first sled surface extending perpendicular to the top side of the base and aligned at a 135° angle relative to a first side of the joint plane, with the first sled surface being resiliently compressible relative to the sled in a direction perpendicular to the first sled surface; and a second sled fence that has a planar second sled surface extending perpendicular to the top side of the base and aligned at a 135° angle relative to a second side of the joint plane, with the second sled surface being resiliently compressible relative to the sled in a direction perpendicular to the second sled surface, and wherein the base comprises:

a first base fence that has a planar first base surface extending perpendicular to the top side of the base and aligned generally parallel to the first sled surface; and a second base fence that has a planar second base surface extending perpendicular to the top side of the base and aligned generally parallel to the second sled surface and wherein the first base fence is pivotally mounted relative to the base on a first pivot axis extending parallel to the miter joint plane and further comprising: a first cam actuator operable to pivot the first base fence about the first pivot axis, whereby the parallel alignment of the first base surface relative to the first sled surface is adjustable to within +/−2°.

2. The miter joint clamp of claim 1 wherein the first and second sled surfaces having friction enhancing workpiece engagement faces thereon.

3. The miter joint clamp of claim 1 wherein the first and second base surfaces have friction reducing workpiece engagement faces thereon.

4. The miter joint clamp of claim 1 wherein each sled surface is biased away from the sled.

5. The miter joint clamp of claim 1 wherein the sled has a member that engages the base to fix the sled's position along the joint plane relative to the base.

6. The miter joint clamp of claim 1, and further comprising:

a first surface extension panel removeably mounted over at least a portion of the first sled surface; and a second surface extension panel removeably mounted over at least a portion of the second sled surface.

7. The miter joint clamp of claim 1 wherein the base has an open section therethrough between the first and second base fences.

8. A miter joint clamp comprising:

a base having a planar top side; and a sled mounted on the base for linear movement with respect to the base relative to a miter joint plane perpendicular to the top side of the base, wherein the sled comprises:

a first sled fence that has a planar first sled surface extending perpendicular to the top side of the base and aligned at a 135° angle relative to a first side of the joint plane, with the first sled surface being resiliently compressible relative to the sled in a direction perpendicular to the first sled surface; and a second sled fence that has a planar second sled surface extending perpendicular to the top side of the base and aligned at a 135° angle relative to a second side of the joint plane, with the second sled surface being resiliently compressible relative to the sled in a direction perpendicular to the second sled surface, and wherein the base comprises:

a first base fence that has a planar first base surface extending perpendicular to the top side of the base and aligned generally parallel to the first sled surface and wherein the first base fence is pivotally mounted relative to the base on a first pivot axis extending parallel to the miter joint plane; and a second base fence that has a planar second base surface extending perpendicular to the top side of the base and aligned generally parallel to the second sled surface and wherein the second fence is pivotally mounted relative to the base on a second pivot axis extending parallel to the miter joint plane; and a first cam actuator operable to pivot the first base fence about the first pivot axis, whereby the parallel alignment of the first base surface relative to the first sled surface is adjustable to within +/−2°; and a second cam actuator operable to pivot the second base fence about the second pivot axis, whereby the parallel alignment of the second base surface relative to the second sled surface is adjustable to within +/−2°.

9. A miter joint clamp comprising:

a base having a planar top side; and a sled mounted on the base for linear movement with respect to the base relative to a miter joint plane perpendicular to the top side of the base, wherein the sled has a planar first sled surface extending perpendicular to the top side of the base and aligned at a 135° angle relative to a first side of the joint plant and a planar second sled surface extending perpendicular to the top side of the base and aligned at a 135° angle relative to a second side of the joint plane;

wherein the base comprises:

a first base fence that has a planar first base surface extending perpendicular to the top side of the base and aligned at a 45° angle relative to the first side of the joint plane, wherein the first base fence is pivotally mounted relative to the base on a first pivot axis extending parallel to the miter joint plane, and wherein the first base fence comprises a first cam actuator operable to pivot the first base fence about the first pivot axis; and a second base fence that has a planar second base surface extending perpendicular to the top side of the base and aligned at a 45° angle relative to the second side of the joint plane.

10. The miter joint clamp of claim 9 wherein a first operative angle alignment of the first base surface relative to the joint plant is 45°, and wherein the first base fence is pivoted by the first cam actuator to within +/−2° of the first operative angle alignment.

11. The miter joint clamp of claim 9 wherein the second base fence is pivotally mounted relative to the base on a second pivot axis extending parallel to the miter joint plane, and wherein the second base fence comprises a second cam actuator operable to pivot the second base fence about the second pivot axis.

12. The miter joint clamp of claim 11 wherein a first operative angle alignment of the first base surface relative to the joint plane is 45°, wherein a second operative angle alignment of the second base surface relative to the joint plane is 45°, and wherein each base fence is pivoted by its respective cam actuator to within +/−2° of the respective operative angle alignment for the base surface of that base fence.

13. The miter joint clamp of claim 9 wherein the first and second sled surfaces have friction enhancing workpiece engagement faces thereon.

14. The miter joint clamp of claim 9 wherein the first and second base surfaces have friction reducing workpiece engagement faces thereon.

15. The miter joint clamp of claim 9 wherein each sled surface is resiliently compressible relative to the sled in a direction perpendicular to that sled surface, and wherein each sled surface is biased away from the sled.

16. The miter joint clamp of claim 9 wherein the sled has a member that engages the base to fix the sled's position along the joint plane relative to the base.

17. The miter joint clamp of claim 9, and further comprising:

a first surface extension panel removeably mounted over at least a portion of the first sled surface; and a second surface extension panel removeably mounted over at least a portion of the second sled surface.

18. The miter joint clamp of claim 9 wherein the base has an open section therethrough between the first and second base fences.

* * * * *